US008192272B2

(12) United States Patent
Thomas et al.

(10) Patent No.: US 8,192,272 B2
(45) Date of Patent: Jun. 5, 2012

(54) WAGERING GAME WITH ENHANCED CASCADING REEL SYMBOL FEATURE

(75) Inventors: Alfred Thomas, Las Vegas, NV (US); Joel R. Jaffe, Glenview, IL (US); Larry J. Pacey, Northbrook, IL (US); Allon G Englman, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 1065 days.

(21) Appl. No.: 11/988,044

(22) PCT Filed: Jun. 29, 2006

(86) PCT No.: PCT/US2006/025894

§ 371 (c)(1),
(2), (4) Date: Dec. 28, 2007

(87) PCT Pub. No.: WO2007/002935

PCT Pub. Date: Jan. 4, 2007

(65) Prior Publication Data

US 2009/0170590 A1 Jul. 2, 2009

Related U.S. Application Data

(60) Provisional application No. 60/694,946, filed on Jun. 29, 2005.

(51) Int. Cl.
*A63F 9/24* (2006.01)

(52) U.S. Cl. ..... 463/20; 463/16; 463/17; 463/18; 463/19; 463/23; 463/25; 463/27

(58) Field of Classification Search ..... 463/16–20, 463/25, 27

See application file for complete search history.

(56) References Cited

U.S. PATENT DOCUMENTS

| | | | | |
|---|---|---|---|---|
| 6,676,512 | B2 | 1/2004 | Fong et al. | |
| 6,855,054 | B2 * | 2/2005 | White et al. | 463/21 |
| 2003/0027623 | A1 * | 2/2003 | Rose | 463/20 |
| 2003/0157981 | A1 * | 8/2003 | Marks et al. | 463/20 |
| 2005/0037836 | A1 * | 2/2005 | Gilmore et al. | 463/25 |

OTHER PUBLICATIONS

International Search Report for Application No. PCT/US2006/025894, dated Apr. 23, 2007,(1 pg).

* cited by examiner

*Primary Examiner* — Sunit Pandya
(74) *Attorney, Agent, or Firm* — Nixon Peabody LLP

(57) ABSTRACT

A gaming system and method for conducting a wagering game during which a designated cascade-triggering outcome can cause some symbols to be removed from the display and can move adjacent symbols to cascade and replace the removed symbols in a cascade outcome. A cascade outcome that includes a winning outcome can pay the player a higher value than the same winning outcome that is not included in a cascade outcome.

25 Claims, 15 Drawing Sheets

WAGERING GAME WITH ENHANCED CASCADING REEL SYMBOL FEATURE

CROSS REFERENCE TO RELATED APPLICATIONS

This application is a U.S. national phase of International Application No. PCT/US2006/025894, filed Jun. 29, 2006, which claims the benefit of priority of U.S. Provisional Patent Application No. 60/694,946, filed Jun. 29, 2005, both of which are incorporated by reference in their entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming machine having a cascading reel feature.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

However, in some of the basic games, the player is not as engaged as he or she could be because once the player wins an award, the basic game is finished, and there are no continuing benefits for having achieved a winning outcome. If the basic game does not have a bonus feature or a progressive feature, the player may feel dissatisfied with only the basic game. Alternatively, if the game includes a bonus game and/or progressive game, but the player does not achieve it, the player may feel dissatisfied even after achieving a win in the basic game.

Thus, there is a need to allow a player to play a wagering game in which after achieving a winning combination, there is another continuing benefit.

SUMMARY OF THE INVENTION

According to one aspect of the present invention, a gaming machine is provided. The gaming machine includes an input device for receiving inputs from a player during the wagering game and the inputs including a wager amount. The gaming machine also includes a display for displaying a plurality of symbols that indicate a randomly selected outcome of the wagering game. The plurality of symbols is located on a plurality of reels and the randomly selected outcome is selected from a plurality of outcomes. The plurality of outcomes includes a cascade-triggering outcome and a plurality of winning outcomes. Each of the plurality of winning outcomes having an associated initial game payout. In response to the randomly selected outcome being the cascade-triggering outcome, both a corresponding symbol is moved and the display displays a cascade outcome. In response to the cascade outcome being one of the plurality of winning outcomes, a cascade payout is awarded that is greater than the initial game payout for that one of the plurality of winning outcomes.

According to another aspect of the invention, a method of conducting a wagering game on a gaming machine is provided. The method includes conducting the wagering game at a gaming machine. The gaming machine has a plurality of reels with a plurality of symbols that indicate a randomly selected outcome of the wagering game. The randomly selected outcome is selected from a plurality of outcomes and the plurality of outcomes includes a plurality of winning outcomes. Each of the plurality of winning outcomes has an associated initial game payout. At least some of the plurality of symbols are displayed on a pay line. In response to one of the plurality of symbols indicating a cascade-triggering outcome, a corresponding symbol is moved. After moving the corresponding symbol, a cascade outcome is displayed. In response to the cascade outcome being one of the plurality of winning outcomes, a player is awarded a cascade amount that is an amount greater than the initial game payout for that one of the plurality of winning outcomes.

According to yet another aspect of the invention, a computer readable storage medium is encoded with instructions for directing a gaming device to perform the above method.

According to yet another embodiment of the present invention, a method of conducting a wagering game on a gaming machine is provided. The method includes receiving a wager input into the gaming machine having a plurality of reels. The gaming machine includes a pay table with winning outcomes and corresponding awards for the winning outcomes. A randomly selected outcome is displayed on a plurality of reels and a player is awarded the corresponding award in response to the randomly selected outcome being one of the winning outcomes. Symbols on at least one of the plurality of reels cascade in response to a cascade-triggering outcome being achieved. In response to one of the winning outcomes being achieved after the symbols have cascaded the player is awarded an amount greater than the corresponding award on the pay table in response.

Additional aspects of the invention will be apparent to those of ordinary skill in the art in view of the detailed description of various embodiments, which is made with reference to the drawings, a brief description of which is provided below.

DETAILED DESCRIPTION

Figure 1:
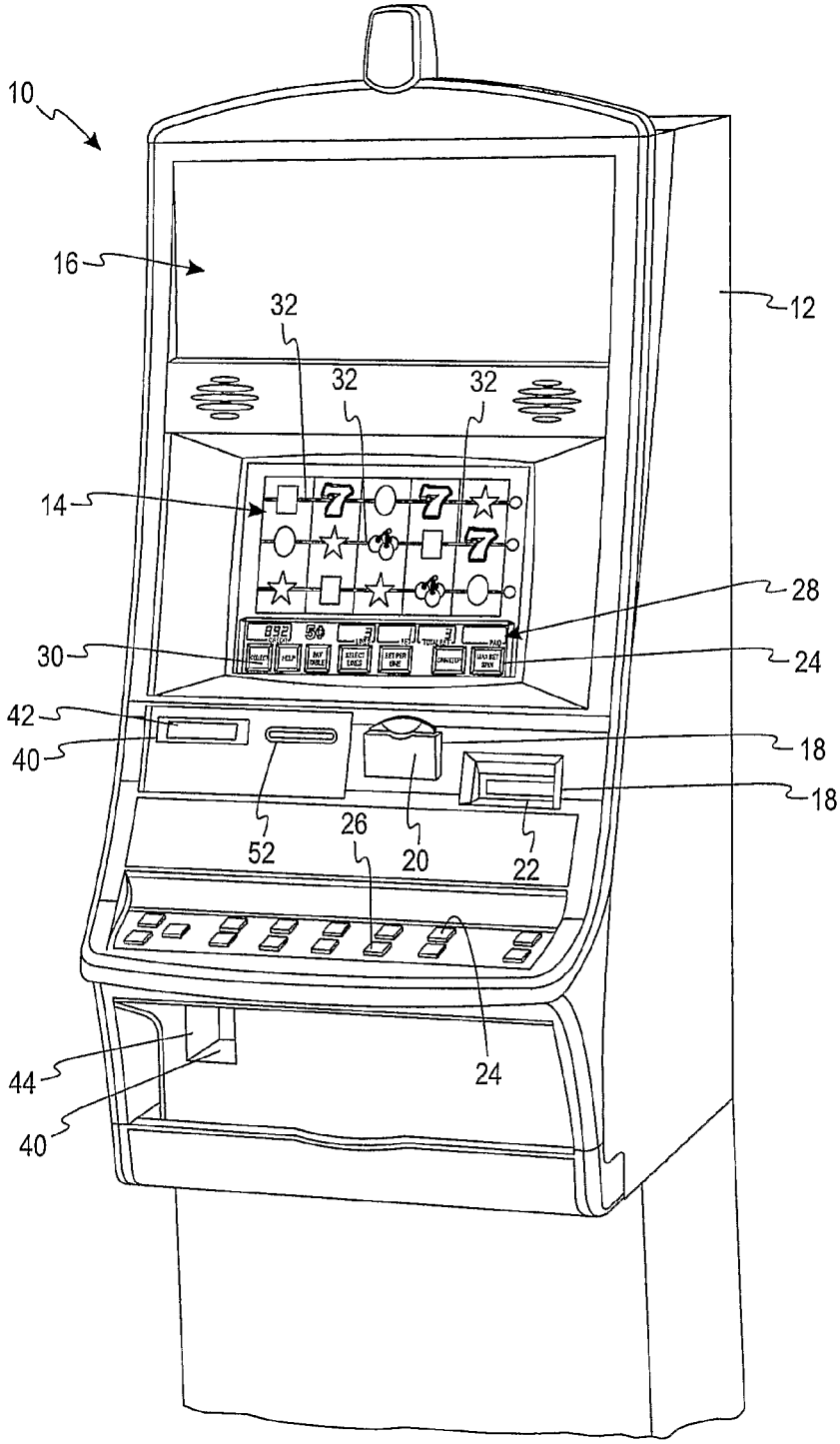
FIG. 1 is a perspective view of a gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1, or may be located outboard of the housing 12 and connected to the housing 12 via a variety of different wired or wireless connection methods. Thus, the gaming machine 10 comprises these components whether housed in the housing 12 or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire monitor (or a portion thereof) to allow players to make game-related selections. Alternatively, the primary display 14 of the gaming machine 10 may include a number of mechanical reels to display the outcome in visual associated to at least one pay line 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaining machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one pay line 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1 as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 2:
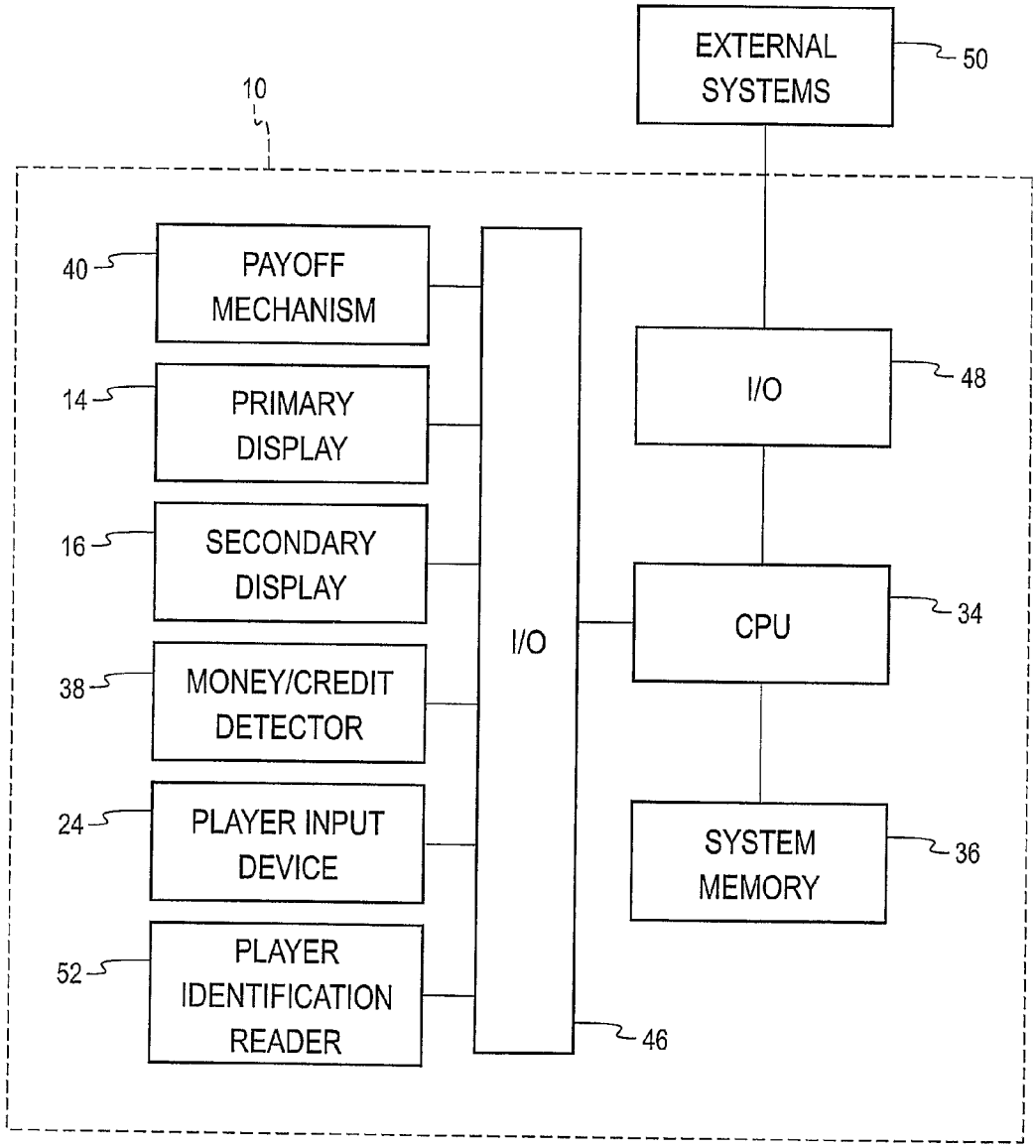
FIG. 2 is a block diagram of a control system suitable for operating the gaming machine.

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36.

Figure 3:
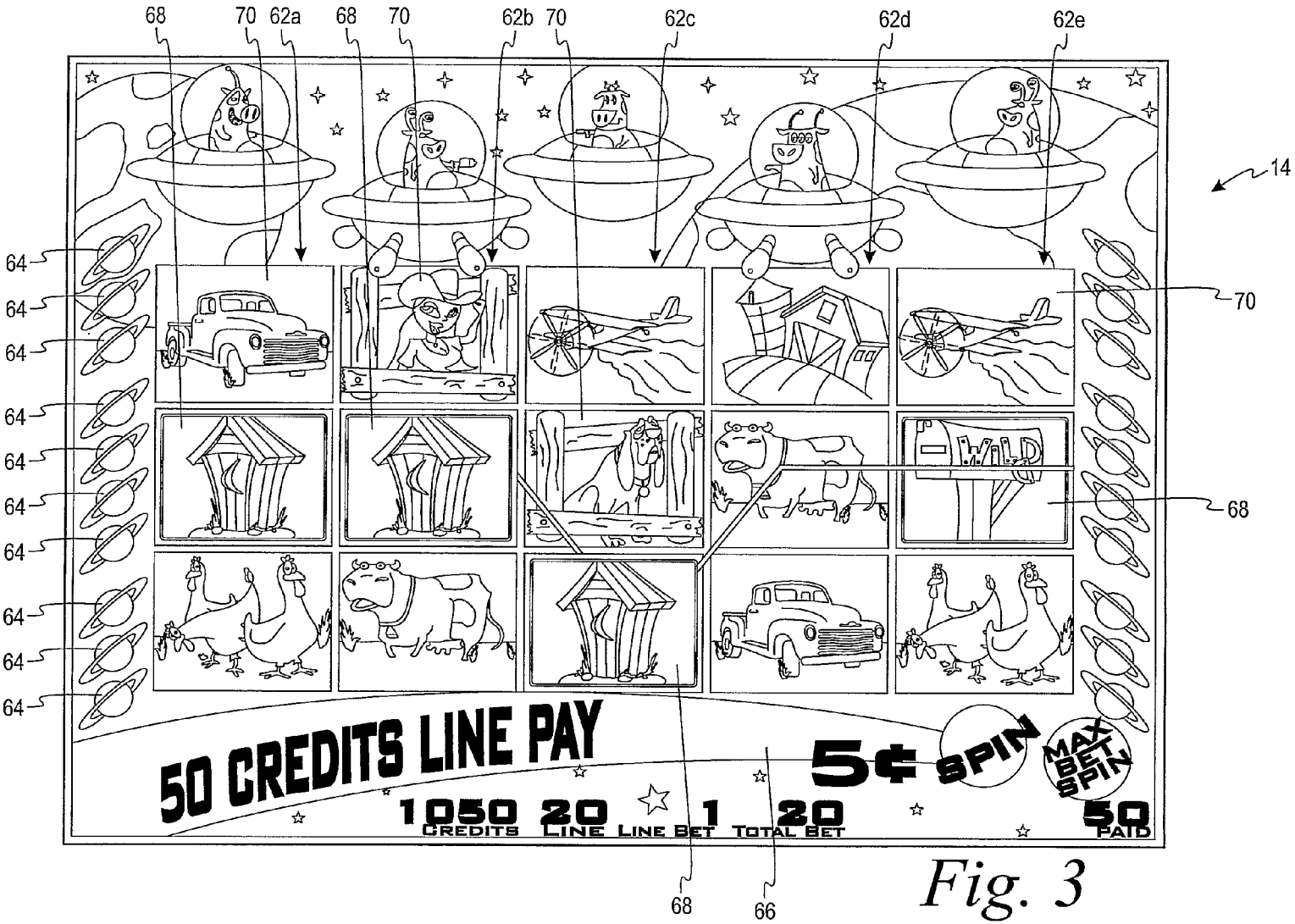
FIG. 3 is a screen of the primary display of the gaming machine of FIG. 1.

Turning now to FIG. 3, the primary display 14 according to one embodiment of the present invention is illustrated. In this embodiment, the basic game is a slot machine game, with symbols on five different reels 62*a*, 62*b*, 62*c*, 62*d*, 62*e*. The reels 62*a-e* may be either traditional mechanical reels, electromechanical reels, or they may be computer-generated images of reels, with each reel composed of a plurality of symbols. In this embodiment, there are multiple pay lines 64 across the various reels 62*a-e*. While multiple pay lines 64 are shown, a gaming machine 10 having a single pay line will also work with the present invention.

During the basic game, the player places a wager on any number of pay lines 64. In the illustrated embodiment, the wager may be between one and five credits per pay line 64. However, in other embodiments, other wager amounts may be made. Once the player has placed the wager, the reels 62*a-e* begin to spin. The result of the spin may be displayed on an outcome indicator 66, and winning pay lines 64 may be highlighted on the primary display 14. In the illustrated example, the pay line having three outhouses, a cow, and a wild symbol is a winning pay line (as highlighted in FIG. 3). The player is awarded an initial basic game payout according to a basic game pay table as shown on the outcome indicator 66. The pay table for the basic game indicates the possible winning combinations of symbols and the initial payout associated with each winning combination prior to any cascading events. For line pays (i.e. winning combinations that must appear on an active pay line), the payout is multiplied by the number of credits wagered on the winning pay line. For scatter pays (i.e. winning combinations that must appear on the display but need not appear on an active pay line), the payout is multiplied by the total number of credits wagered.

Figure 4:
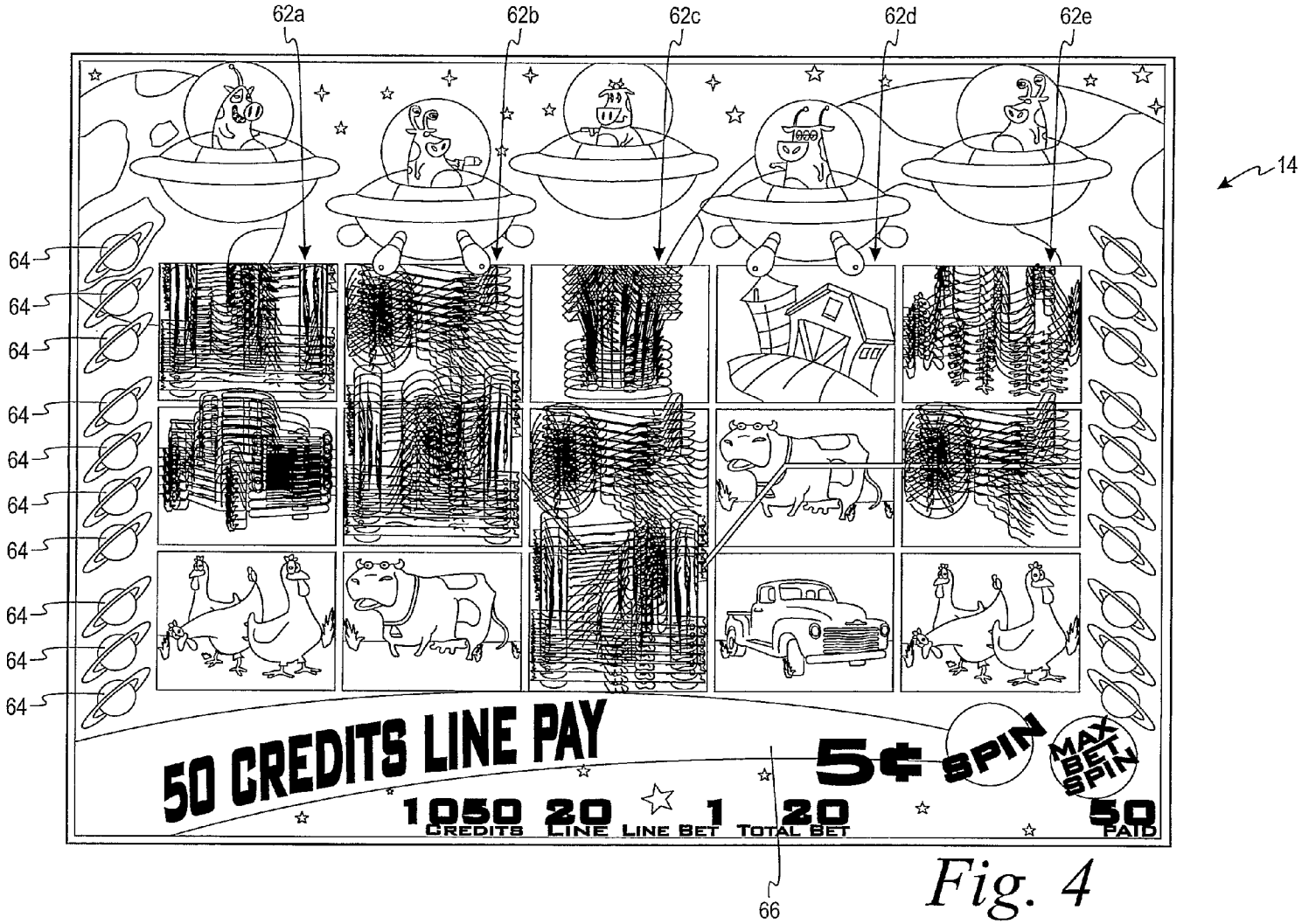
FIG. 4 is a subsequent screen of the primary display of FIG. 3 illustrating a cascading feature according to one embodiment of the present invention.
Figure 5:
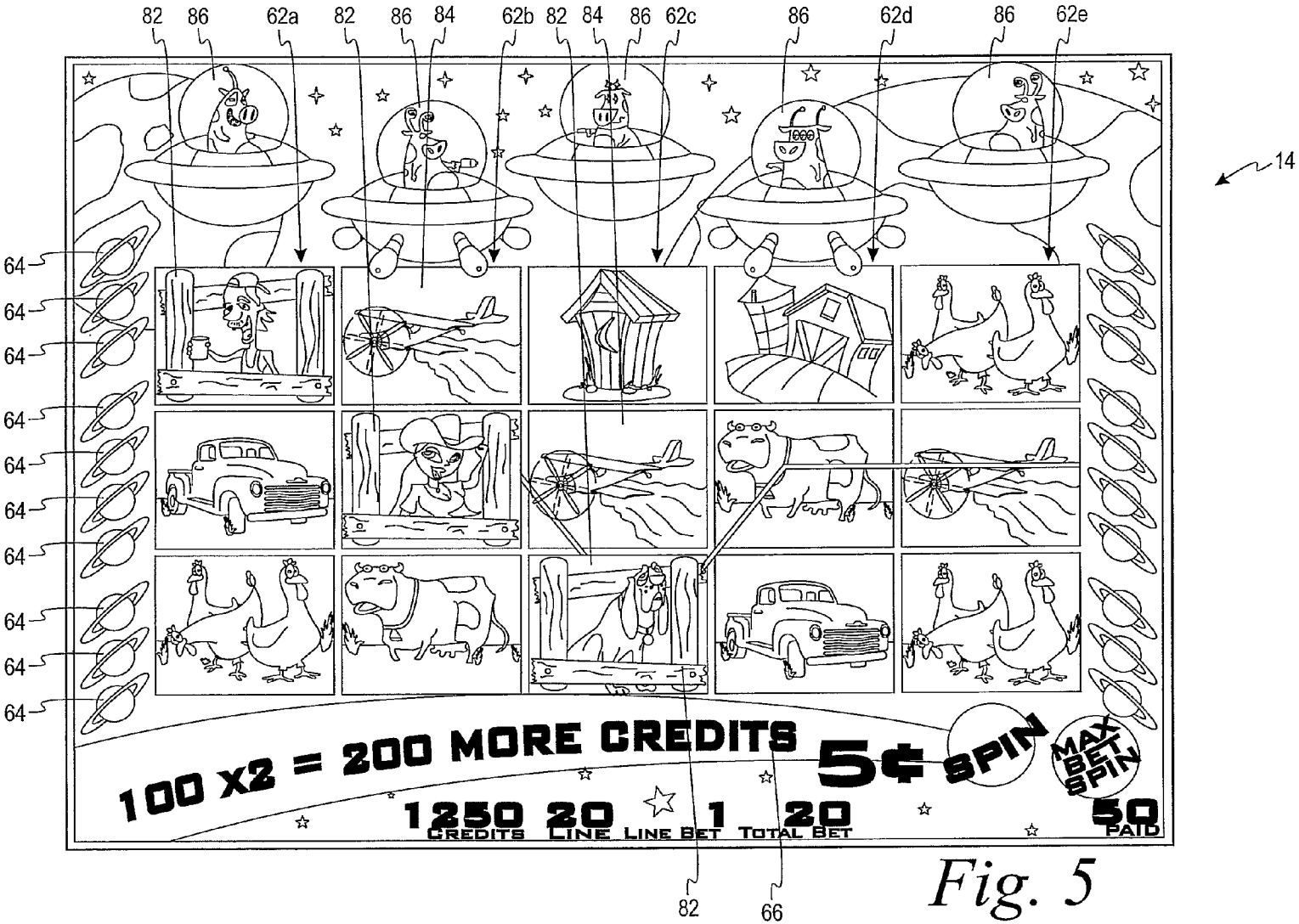
FIG. 5 is a screen of the primary display after the cascade of FIG. 4 has occurred according to one embodiment of the present invention.

In addition to winning the initial basic game payout for the symbol combination in FIG. 3, the player is given another opportunity to win on the same wager. After a winning combination is achieved, winning symbols 68 (in the case of FIG. 3, the three outhouses and the wild symbol) disappear. Symbols 70 above the disappearing symbols cascade down as shown in FIGS. 4 and 5. As shown in FIG. 5, a new winning combination is created on the highlighted reel, which includes new winning symbols 82.

For the winning symbol combination shown in FIG. 5, the initial basic game payout is 100 credits in the pay table. In other words, had the winning symbol combination been achieved in the basic game (FIG. 3), the player would have awarded 100 credits. However, because the outcome is achieved in the cascading event, the player is awarded twice that amount, or 200 credits. As illustrated, the awarded amount (200 credits) for a winning combination that occurs after the cascade is greater than the initial basic game payout (100 credits). This multiplication is displayed to the player in the outcome indicator 66, which, in this case, includes a multiplier of two.

In some embodiments, the new symbols 82 in the winning combination also disappear and symbols 84 above the disappearing symbols 82 cascade down into position, and the player is now rewarded for any new winning combinations. The awarded amount may also be greater than the initial game payout in the pay table for the basic game, or the award that would have been achieved in the first cascading event.

Figure 6:
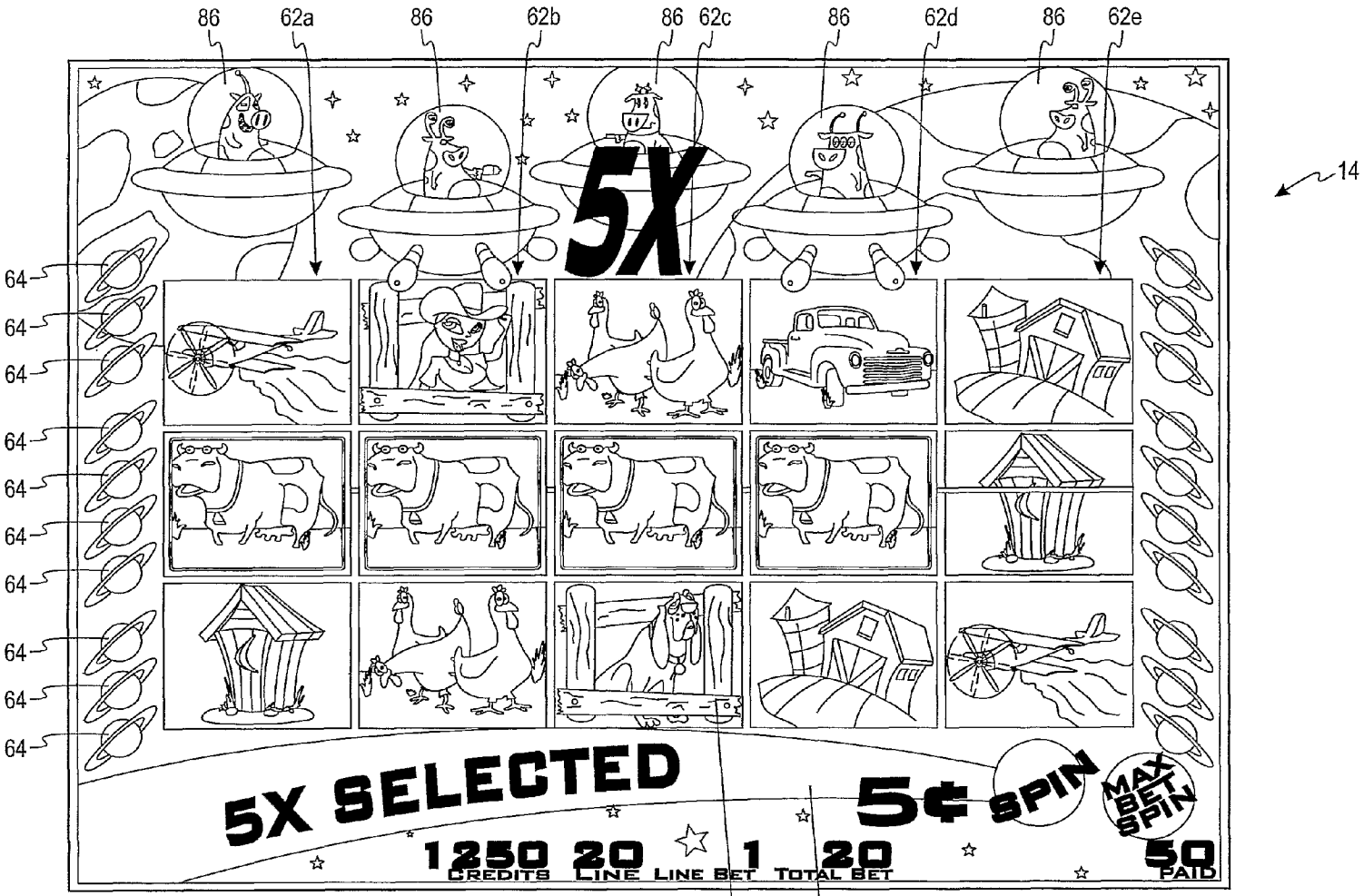
FIG. 6 is a screen of the primary display after another cascade according to one embodiment of the present invention.

In some embodiments, the initial bonus game payout is multiplied by a multiplier and the multiplier is selected by the player. In these embodiments, after the first cascade, the primary display 14 instructs the player to choose one of a plurality of spaceships 86. Each spaceship 86 hides a multiplier. The selected multiplier is revealed to the player as shown in FIG. 6. In the illustrated embodiment, the player selected a five-times multiplier. As a result, the initial basic game payout corresponding to the winning combination achieved by the second cascade is multiplied by five. The multipliers may be any numbers, but in the illustrated embodiment, the multipliers are between three and ten.

In other embodiments, if a new winning combination is achieved from the subsequent cascade, the corresponding basic game payout may be multiplied by a randomly selected multiplier. In some embodiments, the multiplier may stay the same for each cascade (e.g., two). In other embodiments, the multiplier may increase as the number of wins per spin increases. For example, achieving a winning combination on the original spin results in the corresponding initial basic game payout being paid out. A winning combination on a first cascade pays twice the corresponding initial basic game payout listed on the pay table for that winning combination. A winning combination on a second cascade pays three times the corresponding initial game payout listed on the pay table for that winning combination, etc. . . .

Alternatively, the multiplier may increase by a factor of two (or other number) for each cascade. For example, a winning combination in the first cascade pays twice the corresponding initial basic game payout for that combination. A winning combination in a second cascade pays four times the corresponding initial basic game payout for that combination. A winning combination in a third cascade pays eight times the corresponding initial basic game payout for that combination, and a winning combination in a fourth cascade pays sixteen times the corresponding initial basic game payout for that combination.

In some embodiments, the winning symbols 68, 82 that disappear are tracked by the gaming machine 10 (or system controller). Once a player reaches a predetermined goal (e.g., five of each symbol, ten of a particular symbol), the player is awarded an extra award. In other words, this is a "symbol-collection" feature. Once the predetermined number of symbols has been collected by the gaming machine 10 (or system controller), the cascading of symbols begins.

In some embodiments, the cascading may continue until there are no more winning combinations. In other embodiments, the cascade may stop after a predetermined number of cascades (e.g., one or two).

Figure 7:
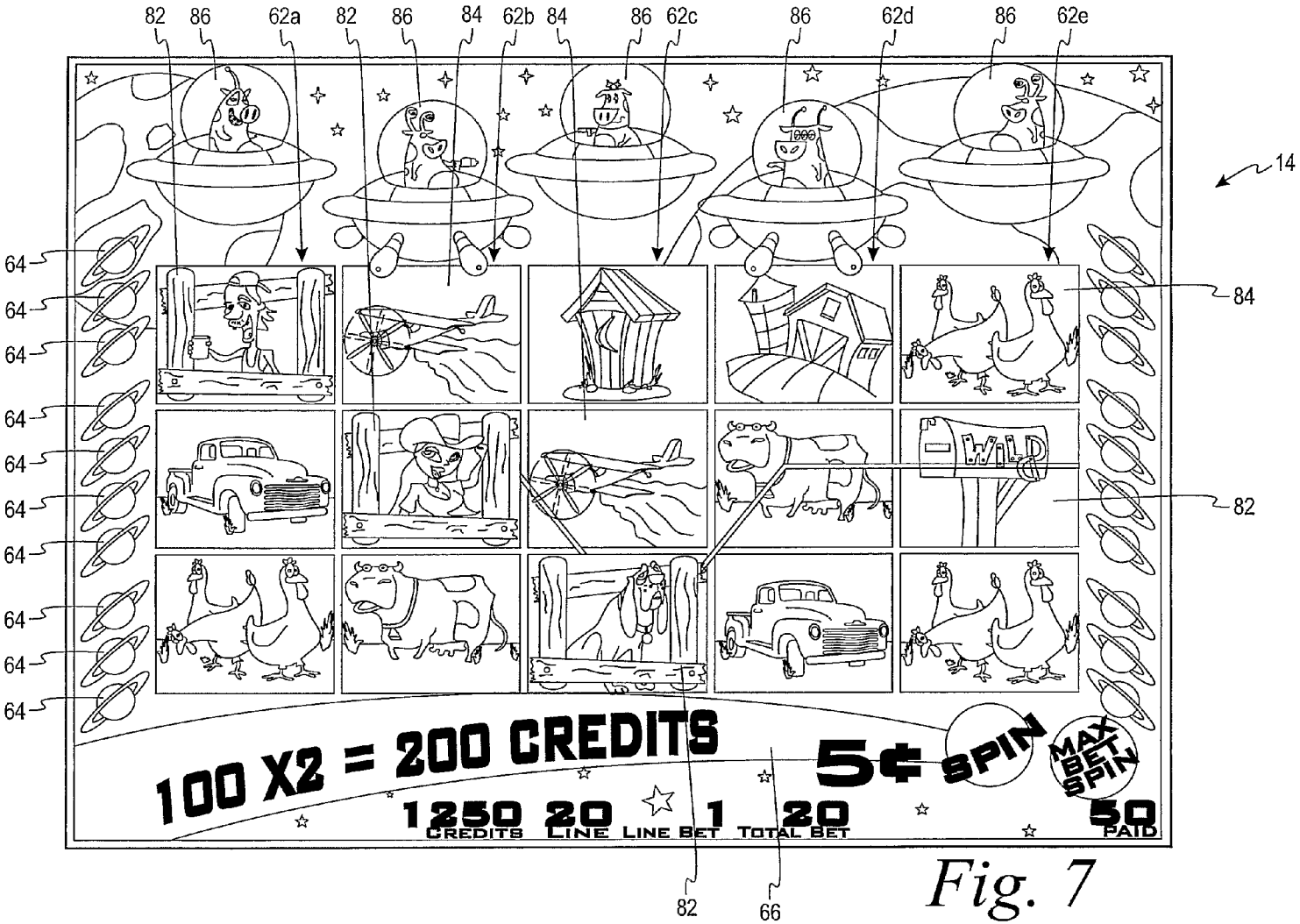
FIG. 7 is a subsequent screen of the primary display of FIG. 3 illustrating a cascading feature according to another embodiment of the present invention.

In another embodiment of the present invention, any "hold" symbols involved in a winning combination do not cascade. The "hold" symbol, which may be beneficial to the player, may be "wild" symbols or "scatter" symbols. Turning now to FIG. 7, after the winning combination of FIG. 3 is achieved, the primary display 14 illustrates the winning symbols 68 disappearing and the symbols 70 cascading down. However, unlike the embodiment illustrated in FIG. 4, in the embodiment of FIG. 7, the "wild" symbol does not disappear. Instead, the "wild" symbol stays and is capable of being used in subsequent winning combinations. Because this increases the player's odds of winning (or at least the player's perception of his or her odds of winning), keeping the "wild" symbol in play provides more player satisfaction.

Figure 8:
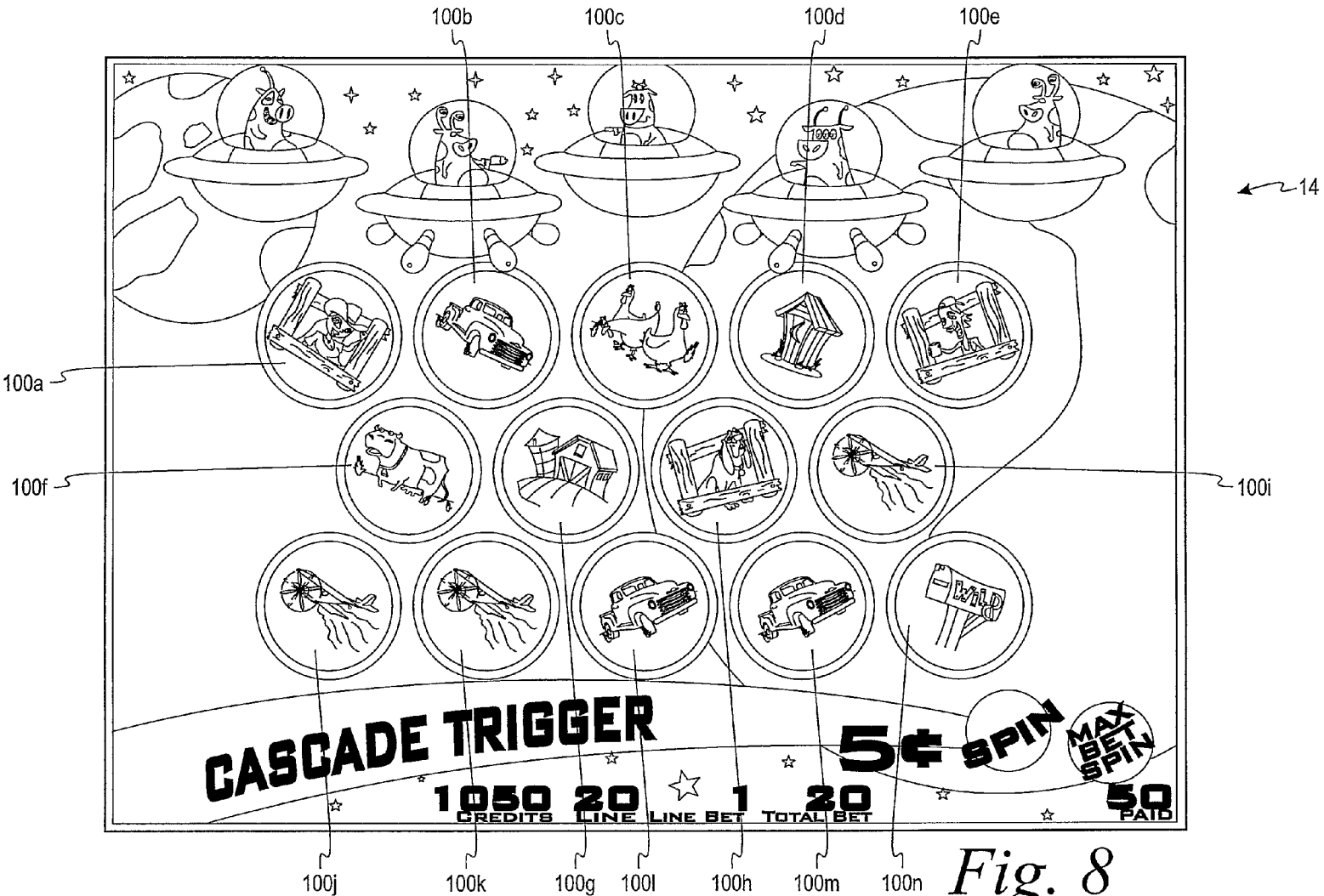
FIG. 8 is an initial screen of the primary display of the gaming machine of FIG. 1 according to another embodiment of the present invention.

Turning now to FIG. 8, another embodiment of the present invention will be described. In this embodiment, the primary display 14 includes fourteen "micro" reels 100*a-n*. Each reel displays a single symbol in a particular location, unlike traditional reels, which often display three or more symbols per column.

Figure 11A:
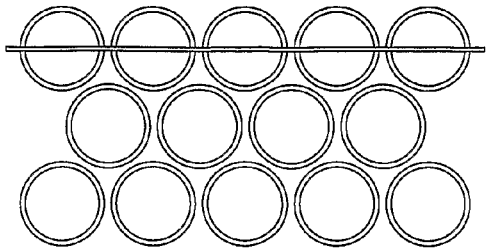
FIGS. 11*a-nn* are a plurality of diagrams illustrating various pay lines according to one embodiment of the present invention.
Figure 11B:
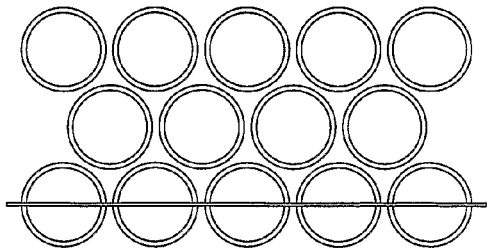
Figure 11C:
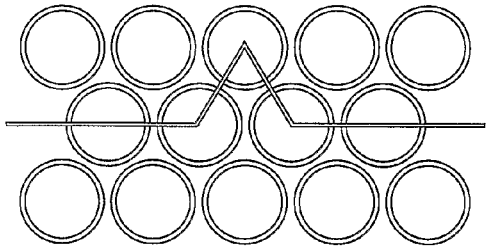
Figure 11D:
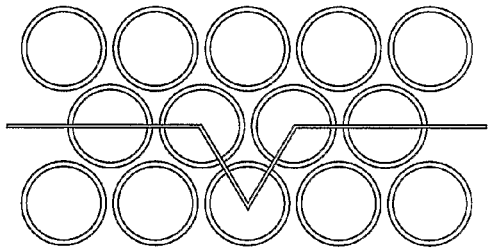
Figure 11E:
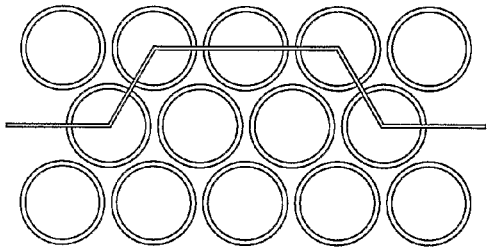
Figure 11F:
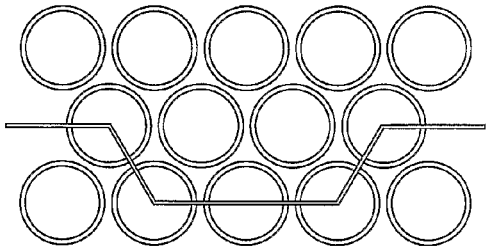
Figure 11G:
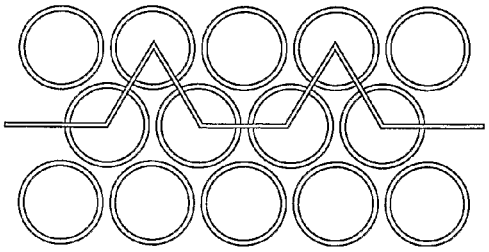
Figure 11H:
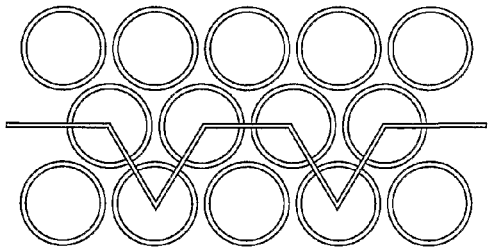
Figure 11I:
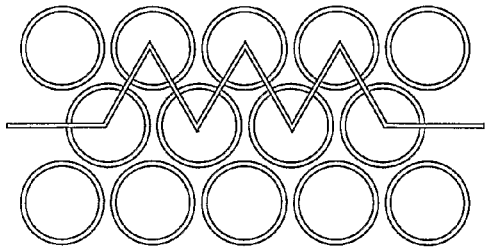
Figure 11J:
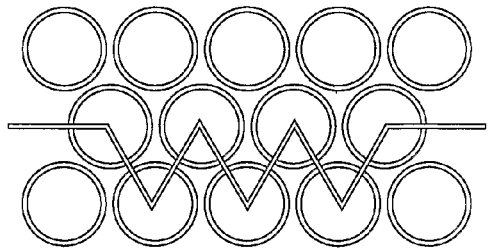
Figure 11K:
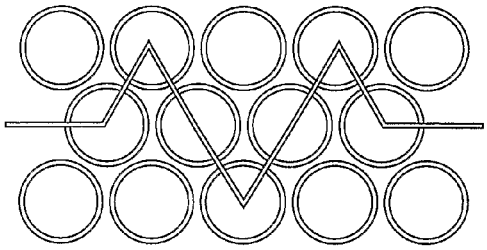
Figure 11L:
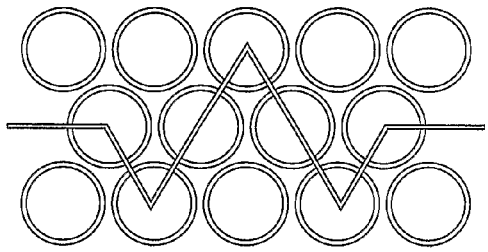
Figure 11M:
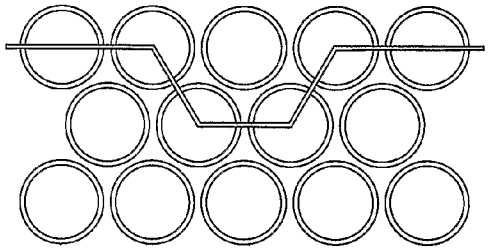
Figure 11N:
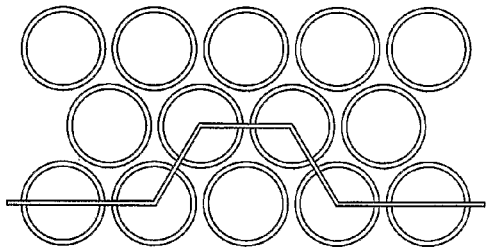
Figure 11O:
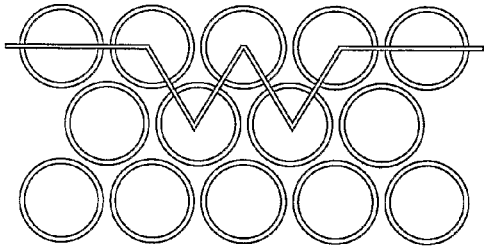
Figure 11P:
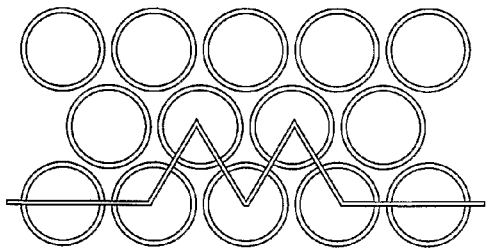
Figure 11Q:
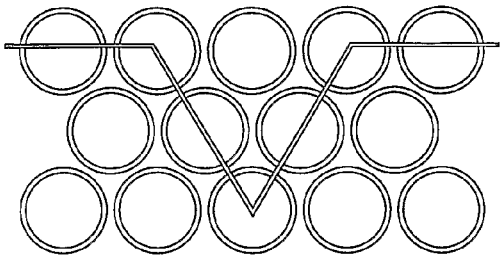
Figure 11R:
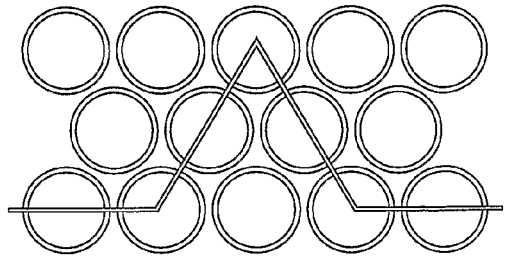
Figure 11S:
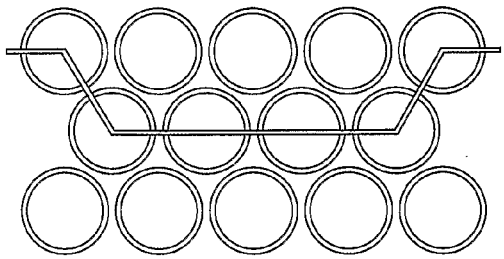
Figure 11T:
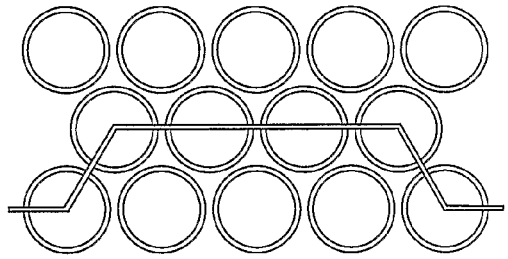
Figure 11U:
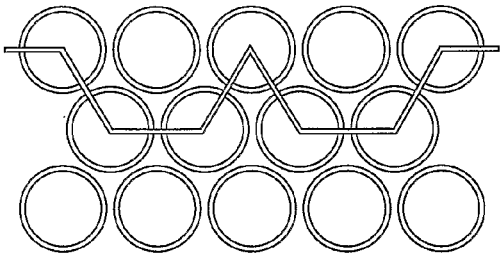
Figure 11V:
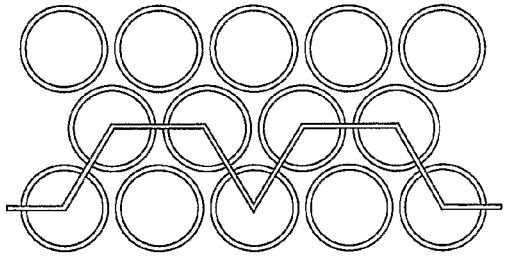
Figure 11W:
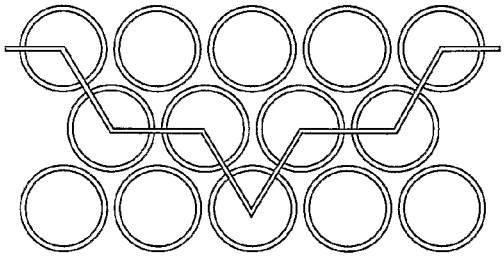
Figure 11X:
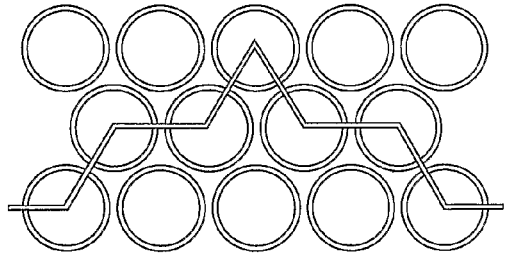
Figure 11Y:
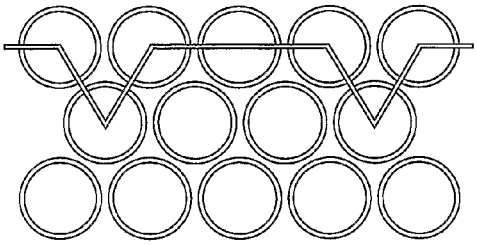
Figure 11Z:
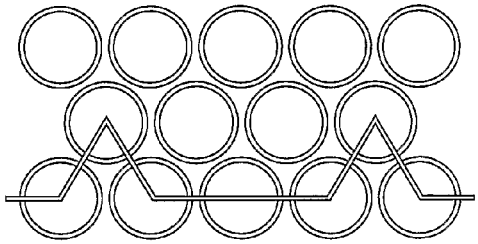
Figure 11A:
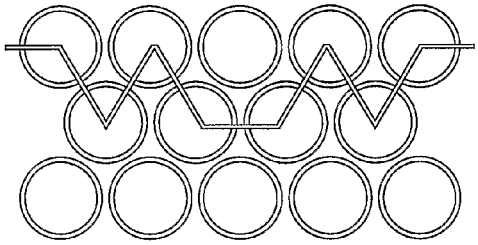
Figure 11B:
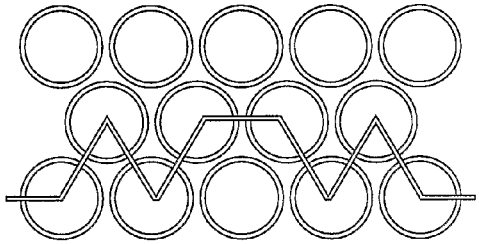
Figure 11C:
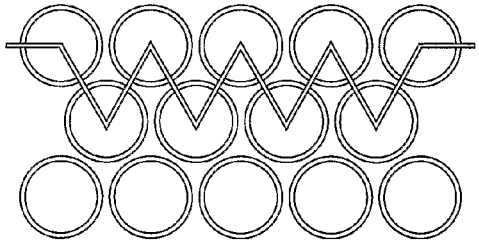
Figure 11D:
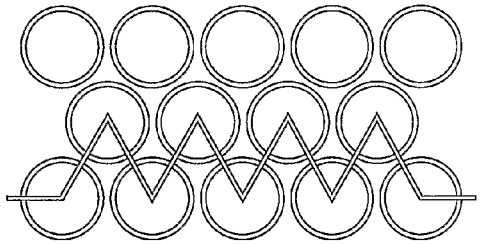
Figure 11E:
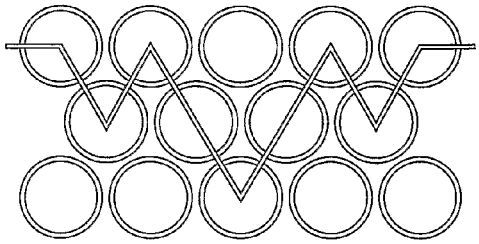
Figure 11F:
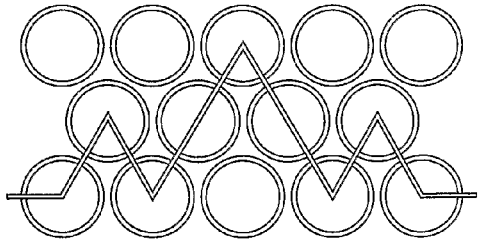
Figure 11G:
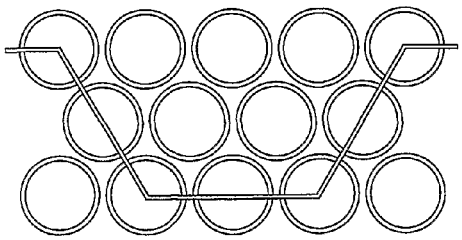
Figure 11H:
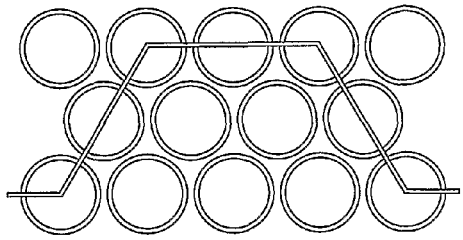
Figure 11I:
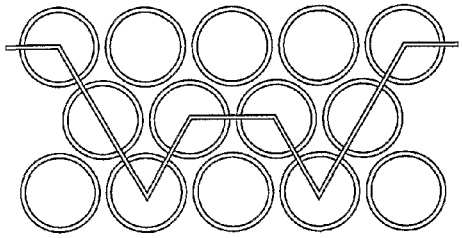
Figure 11J:
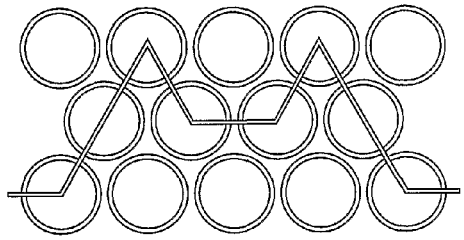
Figure 11K:
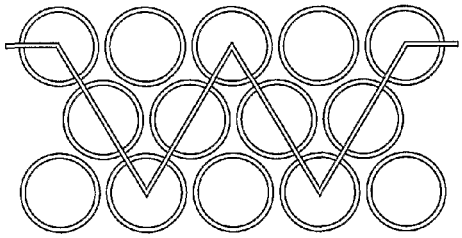
Figure 11L:
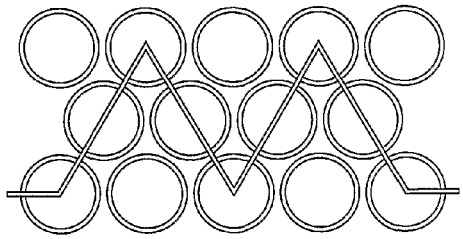
Figure 11M:
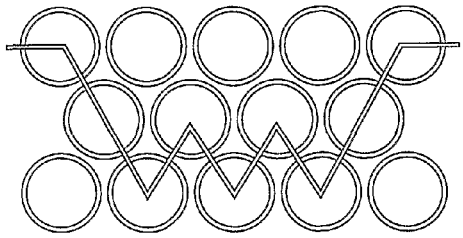
Figure 11N:
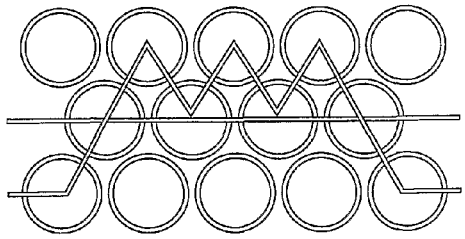

When the player places a wager, the player decides how many credits to wager per line. In the displayed embodiment, there are forty lines and the player may place a wager of up to 5 credits per line. If the player places the maximum wager of 200 credits, a final, forty-first "bonus" line is enabled. The forty-one pay lines are illustrated in FIGS. 11*a-nn*.

As shown in FIG. 8, the seventh reel 10*g* is a barn symbol, which, in this embodiment, is a cascade-trigger symbol. During the wagering game, if the cascade-trigger symbol appears on an active pay line (a pay line on which the player has placed a wager), the reel disappears (FIG. 9) and one of the reels from the line above cascades down into the disappeared reels position (FIG. 10).

As shown in FIG. 8, the seventh reel 100*g* is a barn symbol, which, in this embodiment, is a cascade-trigger symbol. During the wagering game, if the cascade-trigger symbol appears on an active pay line (a pay line on which the player has placed a wager), the reel disappears (FIG. 9) and one of the reels from the row above the disappeared reel cascades down into the disappeared reel's position (FIG. 10).

Figure 9:
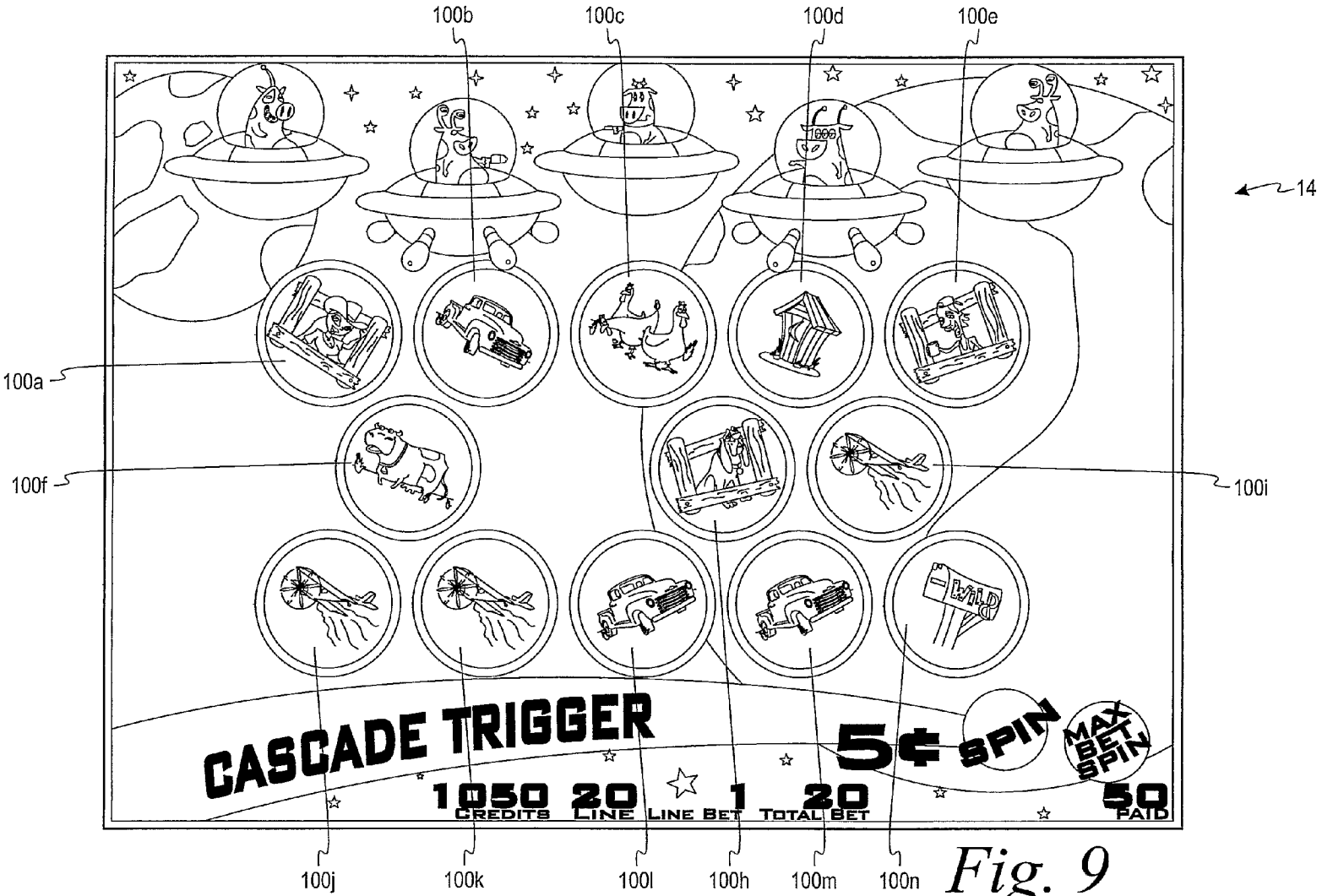
FIG. 9 is a subsequent screen of the primary display of FIG. 8 illustrating a cascading feature according to one embodiment of the present invention.
Figure 10:
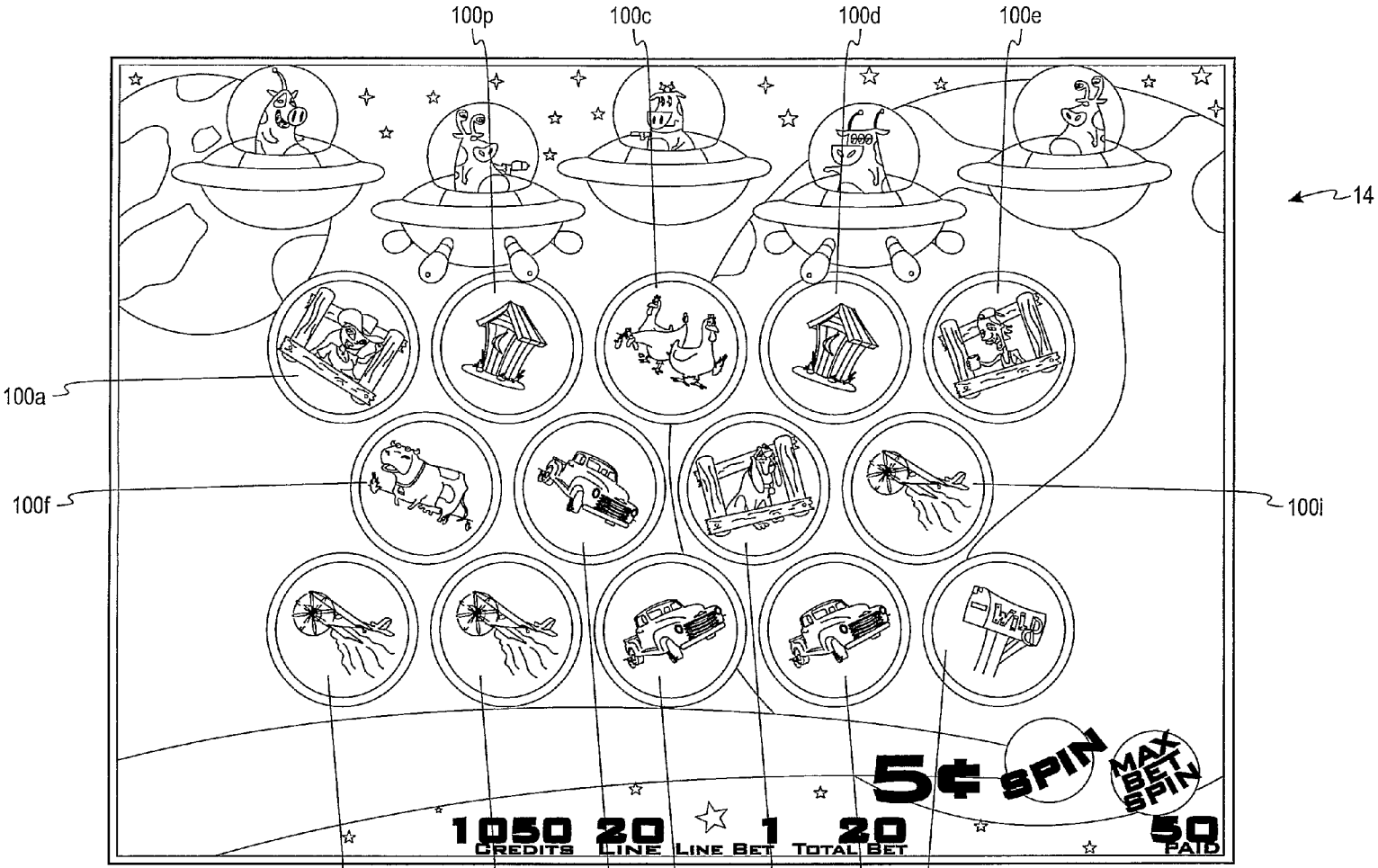
FIG. 10 is a subsequent screen of the primary display of FIG. 8 after the cascading of FIG. 9 according to one embodiment of the present invention.

As shown in FIGS. 8-10, the barn in the seventh reel 100*g* disappears and the second reel 100*b* cascades down into the position vacated by the seventh reel 100*g*. A new reel 100*p* also drops into the position vacated by the second reel 10*b*.

In this embodiment, the reels cascade in a generally downward direction. As shown in FIG. 9, because adjacent rows of reels are offset from each other by one-half reel position, there is not a reel that is directly above the seventh reel 100*g*. Instead, the second reel 100*b* and the third reel 100*c* are both above and diagonally adjacent to the cascade-trigger reel 100*g*. In order to determine which of the two reels 100*b*, 100*c* should cascade, the gaming machine 10 (or system controller) reviews the tilt of the symbols in the two adjacent reels 100*b*, 100*c*. Whichever reel 100*b*, 100*c* includes a symbol that tilts toward the cascade-triggering reel 100*g* is the reel that cascades down into the disappeared reel's position. If neither (or both) of the symbols tilts toward the cascade-triggering reel 100*g*, then the gaming machine 10 (or system controller) may randomly determine which reel cascades. Alternatively, certain symbols (or reels) may be weighted over others, and those may cascade. In other embodiments, the symbol which would create the most winning combinations for the player would cascade.

Although in the above embodiment, it is the tilt of the cascading reel that determines which reel cascades, in other embodiments, it may be the tilt of the symbol in the cascade-triggering reel 100*g* that determines the direction of the cascade. In other embodiments, the determination may be completely random, determined by a weighted system, determined by an arrow located on either the cascading reel or cascade-triggering reel, or based upon whichever symbol would generate the most winning combinations or highest pay outs.

After the reels have cascaded into place, as shown in FIG. 10, the new symbol combinations are again evaluated for winning combinations. If a cascade-triggering symbol appears in any of the reels, then a new cascade begins. Alternatively, the second cascade may be triggered by a winning combination. In such an embodiment, all of the symbols involved in the winning combination would disappear, and a new cascade would occur. As described above, any payouts resulting from a cascade may be multiplied by permitting a player to select one of the spaceships.

After the reels have cascaded into place, as shown in FIG. 10, the new symbol combinations are again evaluated for winning combinations. If a cascade-triggering symbol appears in any of the reels, then a new cascade begins. Alternatively, the second cascade may be triggered by a winning combination. In such an embodiment, all of the symbols involved in the winning combination would disappear, and a new cascade would occur.

Each of these embodiments and obvious variations thereof is contemplated as falling within the spirit and scope of the claimed invention, which is set forth in the following claims.

What is claimed is:

1. A gaming system comprising:

at least one input device for receiving inputs from a player during a wagering game, the inputs including a wager amount;

at least one display device for displaying a symbol combination of symbols from a plurality of symbols on a plurality of reels;

one or more processors connected to the at least one input device and the at least one display device, and being operable to:

display the symbol combination comprising a randomly selected outcome selected from a plurality of outcomes, the plurality of outcomes including at least one cascade-triggering outcome and a plurality of winning outcomes, each of the plurality of winning outcomes having an associated initial game payout;

in response to the displayed symbol combination comprising the at least one cascade-triggering outcome, remove at least one symbol from the symbol combination, and move an adjacent symbol in the symbol combination to replace the at least one removed symbol to display a cascade outcome; and, in response to the cascade outcome being one of the plurality of winning outcomes, award a cascade payout with a higher value than the initial game payout associated with that one of the plurality of winning outcomes such that the winning outcome, displayed as the cascade outcome, pays a higher value than the same winning outcome would if achieved from an initial random generation.

2. The gaming system of claim 1, wherein the cascade-triggering outcome is one of the plurality of winning outcomes.

3. The gaming system of claim 2, wherein, in response to the randomly selected outcome being the cascade-triggering outcome, the player is awarded an initial game payout associated with the cascade-triggering outcome.

4. The gaming system of claim 1, wherein, in response to the cascade outcome being one of the plurality of winning outcomes, the cascade payout is equal to the initial game payout associated with that one of the plurality of winning outcomes multiplied by a multiplier.

5. The gaming system of claim 4 wherein the multiplier is randomly selected.

6. The gaming system of claim 1, wherein, in response to the cascade outcome being one of the plurality of winning outcomes, at least a second symbol is removed, a second adjacent symbol is moved in the symbol combination to replace the second removed symbol, and the display displays a second cascade outcome including a plurality of winning outcomes.

7. The gaming system of claim 6, wherein, in response to the second cascade outcome being one of the plurality of winning outcomes, a second payout amount is awarded in an amount greater than the initial game payout associated with that one of the plurality of winning outcomes.

8. The gaming system of claim 7, wherein, in response to the second cascade outcome being one of the plurality of winning outcomes, the second payout amount is equal to the initial game payout associated with that one of the plurality of winning outcomes multiplied by a multiplier selected by the player.

9. The gaming system of claim 1, wherein the symbols include at least one hold symbol, such that if the at least one hold symbol is part of the cascade-triggering outcome, the at least one hold symbol does not move.

10. The gaming system of claim 9, wherein the at least one hold symbol is selected from the group comprising a wild symbol and a scatter symbol.

11. The gaming system of claim 1, wherein the at least one symbol is at least a part of the cascade-triggering outcome.

12. A method of conducting a wagering game on a gaming machine, the method comprising:

conducting the wagering game on a gaming machine, the gaming machine having a plurality of reels with a plurality of symbols that indicate a randomly selected outcome of the wagering game, the randomly selected outcome being selected from a plurality of outcomes, the plurality of outcomes including a plurality of winning outcomes and at least one cascade-triggering outcome, each of the plurality of winning outcomes having an associated initial game payout;

displaying at least some of the plurality of symbols on a pay line;

in response to one of the displayed symbols indicating a cascade-triggering outcome, removing at least one of the symbols displayed on the payline and moving an adjacent symbol onto the payline to replace the at least one removed symbol;

after moving the adjacent symbol, displaying a cascade outcome on the payline; and in response to the cascade outcome being one of the plurality of winning outcomes, awarding a player a cascade amount that is an amount greater than the initial game payout associated with that one of the plurality of winning outcomes such that the winning outcome, displayed as the cascade outcome, pays a higher value than the same winning outcome would if achieved from an initial random generation.

13. The method of claim 12, wherein all the symbols indicating the cascade-triggering outcome are removed.

14. The method of claim 12, wherein the cascade-triggering outcome is one of the plurality of winning outcomes.

15. The method of claim 12, further comprising a symbol-collection feature, the symbol-collection feature tracking the removed symbols until a predetermined number of symbols are removed.

16. The method of claim 15, wherein, in response to tracking a predetermined number of removed symbols, awarding a player a tracking award.

17. The method of claim 12, wherein the plurality of symbols have a direction orientation, the direction orientation determining a direction the adjacent symbol moves to replace the removed symbol.

18. The method of claim 17, wherein the direction orientation is a tilt, and the tilt of an adjacent symbol determines the direction that the adjacent symbol moves to replace the removed symbol.

19. The method of claim 12, wherein the direction orientation of the adjacent symbol is determined by an outcome resulting from the move.

20. The method of claim 19, wherein the direction resulting in the most winning outcomes is the direction of the movement of the symbol.

21. The method of claim 12, wherein each of the plurality of symbols is located on a distinct reel.

22. The method of claim 12, wherein the plurality of symbols are not in vertical alignment with one another, and the cascade-trigger outcome causes a movement of non-vertically aligned symbols.

23. A method of conducting a wagering game on a gaming machine, the method comprising:

receiving a wager input into the gaming machine having a plurality of reels, the gaming machine including a pay table with winning outcomes and corresponding awards for the winning outcomes;

displaying a randomly selected outcome on a plurality of reels;

awarding a player the corresponding award in response to the randomly selected outcome being one of the winning outcomes;

removing at least one symbol from the displayed outcome, and moving an adjacent symbol on at least one of the plurality of reels to replace the removed symbol; and awarding the player an amount greater than the corresponding award on the pay table in response to one of the winning outcomes being achieved after the symbol has moved such that the winning outcome, achieved after removing and replacing the at least one symbol, pays a higher value than the same winning outcome would if achieved from an initial random generation.

24. The method of claim 23, wherein the awarding the player an amount greater than the corresponding award includes multiplying the corresponding award by a multiplier.

25. The method of claim 24, wherein the multiplier is a player-selectable multiplier, and the method further comprising hiding the value of a plurality of multipliers and, in response to the player selecting one of the plurality of multipliers, revealing the value of the selected multiplier.

* * * * *